US010780569B2

(12) United States Patent
Constantine et al.

(10) Patent No.: US 10,780,569 B2
(45) Date of Patent: Sep. 22, 2020

(54) KNIFE HAVING ADJUSTABLE HANDLE

(71) Applicant: ACME UNITED CORPORATION, Fairfield, CT (US)

(72) Inventors: Richard S. Constantine, Monroe, CT (US); Siu-Leung Tang, Kowloon (HK)

(73) Assignee: ACME UNITED CORPORATION, Fairfield, CT (US)

( * ) Notice: Subject to any disclaimer, the term of this patent is extended or adjusted under 35 U.S.C. 154(b) by 108 days.

(21) Appl. No.: 15/911,585

(22) Filed: Mar. 5, 2018

(65) Prior Publication Data

US 2019/0270194 A1 Sep. 5, 2019

(51) Int. Cl.

| | |
|---|---|
| ***B25G 1/06*** | (2006.01) |
| ***B25G 1/10*** | (2006.01) |
| *B26B 3/00* | (2006.01) |

(52) U.S. Cl.

CPC ..... *B25G 1/06* (2013.01); *B25G 1/102* (2013.01); *B26B 3/00* (2013.01)

(58) Field of Classification Search

CPC .. B25G 1/06; B25G 1/102; B25G 1/04; B26B 3/00; A63B 53/14; A63B 60/06; A63B 60/08; A63B 60/30; A63B 49/08

See application file for complete search history.

(56) References Cited

U.S. PATENT DOCUMENTS

| | | | | | |
|---|---|---|---|---|---|
| 3,915,021 | A * | 10/1975 | Schwartz | B23B 31/40 | 74/89.27 |
| 5,263,275 | A * | 11/1993 | Rumbaugh | A01K 87/08 | 43/23 |
| 5,832,791 | A * | 11/1998 | Lin | B25B 13/463 | 81/62 |
| 6,030,302 | A * | 2/2000 | Chojnacki | A63B 49/08 | 473/531 |
| 6,146,038 | A * | 11/2000 | Mittersinker | B43K 23/004 | 15/443 |
| 6,419,601 | B1 * | 7/2002 | Kenner | B25G 1/063 | 473/552 |
| 7,578,731 | B1 * | 8/2009 | Moore | A22B 5/0047 | 452/103 |
| 7,621,023 | B2 * | 11/2009 | Pyatt | B25G 1/102 | 15/144.1 |
| 9,931,745 | B2 * | 4/2018 | Freuler | B25G 1/04 | |
| 10,046,217 | B2 * | 8/2018 | Golden | A63B 60/16 | |

* cited by examiner

*Primary Examiner* — Hadi Shakeri
*Assistant Examiner* — Makena S Markman
(74) *Attorney, Agent, or Firm* — Bond Schoeneck & King, PLLC; George McGuire

(57) ABSTRACT

A knife handle assembly adapted for attachment to a knife blade, including an elongated handle having a cavity formed therein and a pliable section positioned adjacent the cavity; an elongated rod extending along a longitudinal axis and into the cavity; a user engageable member attached to the rod on the exterior of said handle and adapted to permit selective rotation of the rod about its longitudinal axis; and a first cam positioned within the cavity and in abutting relation to the pliable section and engaged with the rod, wherein rotation of the rod about its longitudinal axis translates to movement of the first cam into said pliable section an amount corresponding to the degree of rotation.

5 Claims, 5 Drawing Sheets

KNIFE HAVING ADJUSTABLE HANDLE

FIELD OF THE INVENTION

The present disclosure is directed generally to cutlery, and more particularly to knives having a handle that is adjustable in width to accommodate users with different sized hands.

BACKGROUND

Tools, such as cutlery, and in particular fixed blade knives, have handles that if improperly sized for the user can result in slippage and consequent injury to the user. Thus, it is common for each user of a knife to buy one particular to that person's hand-size and desired grip. If another person is to use the same knife, however, it may not be as appropriate a fit. Moreover, even if one handle works well for a particular user for one task, for safety and/or effectiveness he or she may need to hold the knife differently and desire a different sized handle for a different task.

Accordingly, there is a need in the art for knife having a handle that may be adjusted in terms of its width and circumference.

SUMMARY

The present disclosure is directed to a tool, such as for example a knife, having a handle with a width/circumference that is selectively adjustable. In accordance with an embodiment, a knife will be described, it being understood that the present invention can be applied to a variety of handled tools, such as but not limited to: axes, hatchets, knives, screwdrivers, hammers, guns, kitchen tools, sporting goods, fishing tools, snow shovels, cleaning tools, and the like.

According to an aspect is a tool handle assembly adapted for attachment to an implement, comprising an elongated handle having a cavity formed therein and a pliable section positioned adjacent the cavity; an elongated rod extending along a longitudinal axis and into the cavity; a user engageable member attached to the rod on the exterior of said handle and adapted to permit selective rotation of the rod about its longitudinal axis; and a first cam positioned within the cavity and in abutting relation to the pliable section and engaged with the rod, wherein rotation of the rod about its longitudinal axis translates to movement of the first cam into said pliable section an amount corresponding to the degree of rotation.

According to an embodiment, the tool handle further comprises a second cam positioned within the cavity in spaced relation to the first cam and in abutting relation to the pliable section and engaged with the rod, wherein rotation of the rod about its longitudinal axis translates to movement of the second cam into the pliable section an amount corresponding to the degree of rotation.

According to an embodiment, the tool handle assembly further comprises: first and second worm gears integrated with the rod; and first and second gears integrated with the first and second, cams, respectively, wherein each of the first and second worm gears mesh with the first and second gears, respectively, whereby rotation of the rod causes the first and second gears to be driven by the first and second worm gears, respectively.

According to an embodiment, the tool handle assembly further comprises a clutch gear operable between engaged and disengaged positions and operatively interconnected with the user engageable member.

According to an aspect is a tool, comprising: an implement; a handle assembly to which the implement is connected, the handle assembly comprising: an elongated handle having a cavity formed therein and a pliable section positioned adjacent the cavity; an elongated rod extending along a longitudinal axis and into the cavity; a user engageable member attached to the rod on the exterior of the handle and adapted to permit selective rotation of the rod about its longitudinal axis; and a first cam positioned within the cavity and in abutting relation to the pliable section and engaged with the rod, wherein rotation of the rod about its longitudinal axis translates to movement of the first cam into the pliable section an amount corresponding to the degree of rotation.

According to an aspect is a method for selectively modifying the dimension of a tool handle that has a pliable portion and is part of a tool handle assembly that includes a user engageable knob that is adapted for selective rotation about its longitudinal axis, comprising the step of rotating the knob about its longitudinal axis, whereby the pliable portion of the handle moves an amount corresponding to the rotational movement.

These and other aspects of the invention will be apparent from the embodiments described below.

BRIEF DESCRIPTION OF THE DRAWINGS

The present invention will be more fully understood and appreciated by reading the following Detailed Description in conjunction with the accompanying drawings, in which.

DETAILED DESCRIPTION OF EMBODIMENTS

The present disclosure describes a knife handle assembly with a selectively adjustable handle, a knife having a handle that is selectively adjustable, and a method for adjusting the handle of a knife.

Figure 1A:
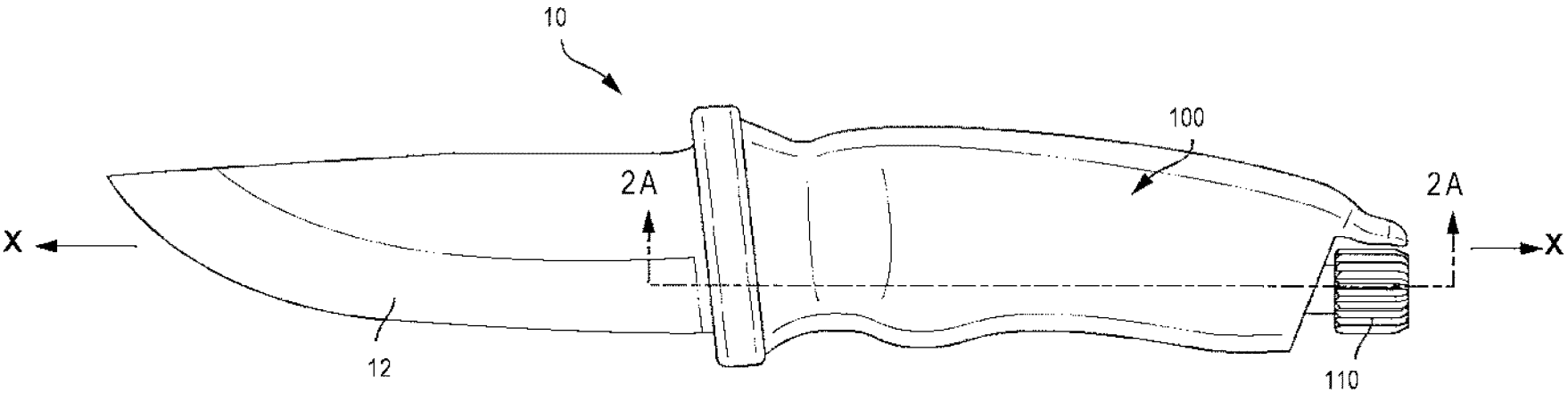
FIGS. 1A and 1B are side elevation views of a knife having a handle that is adjusted between a first (FIG. 1A) and second (FIG. 1B) position, in accordance with an embodiment.
Figure 1B:
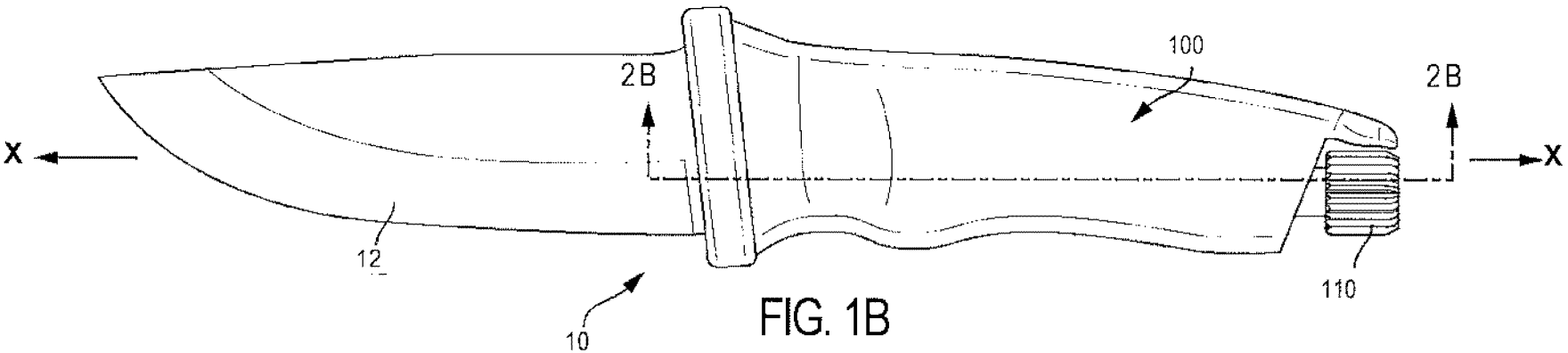
Figure 2A:
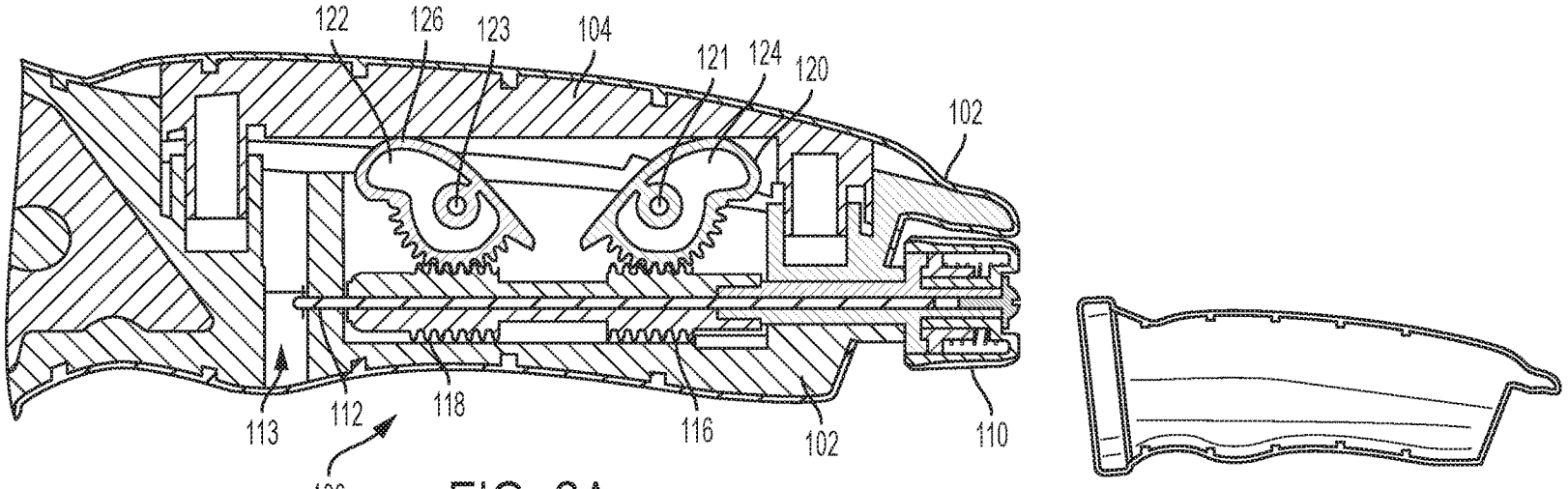
FIGS. 2A and 2B are cross-sectional views taken along section lines 2A-2A of FIGS. 1A and 2B-2B of FIG. 1B, respectively, in accordance with an embodiment.
Figure 2B:
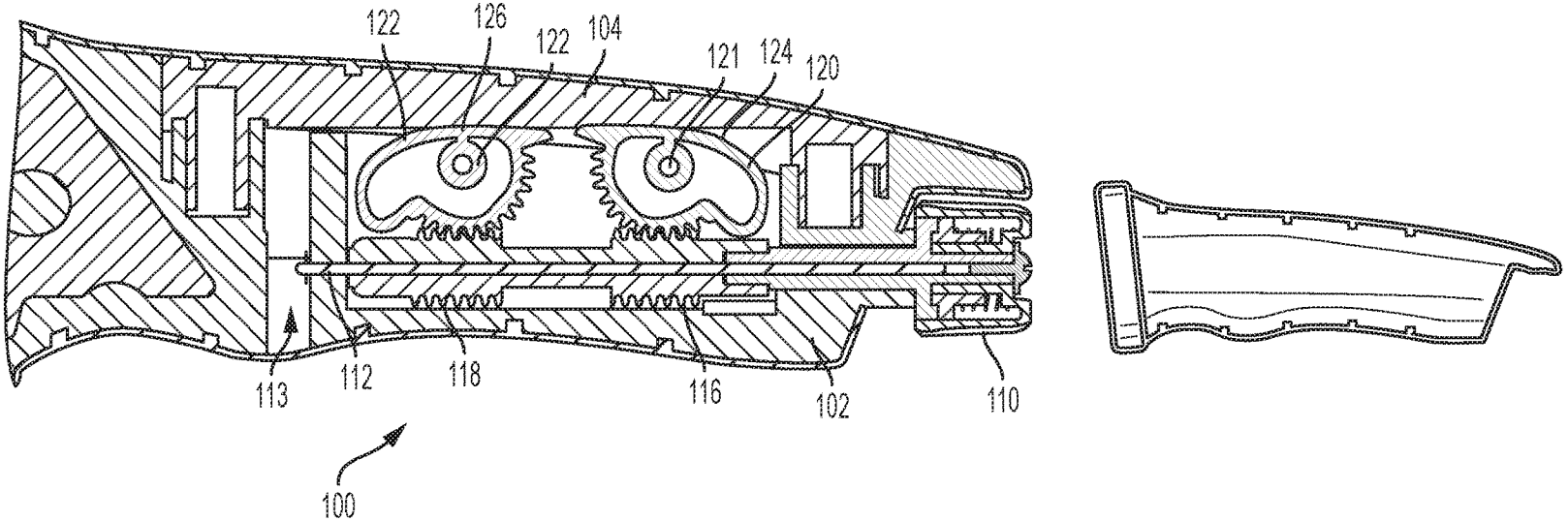
Figure 3A:
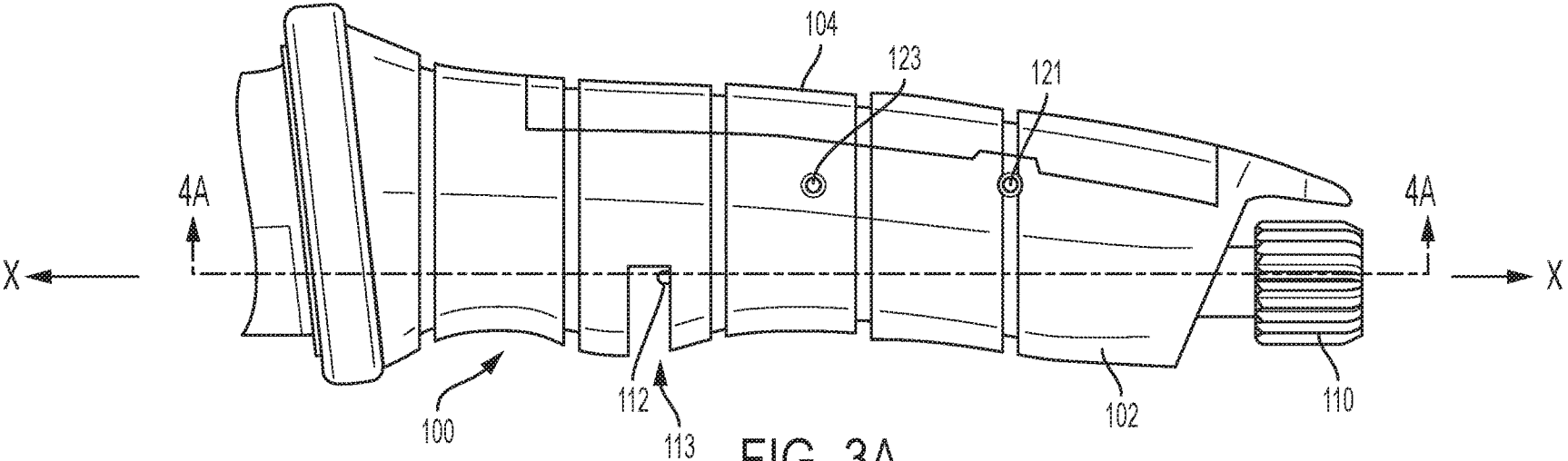
FIGS. 3A and 3B are side elevation views of the handle assembly in the first and second positions of FIG. 1A and FIG. 1B, respectively, without the covering on the handle, in accordance with an embodiment.
Figure 3B:
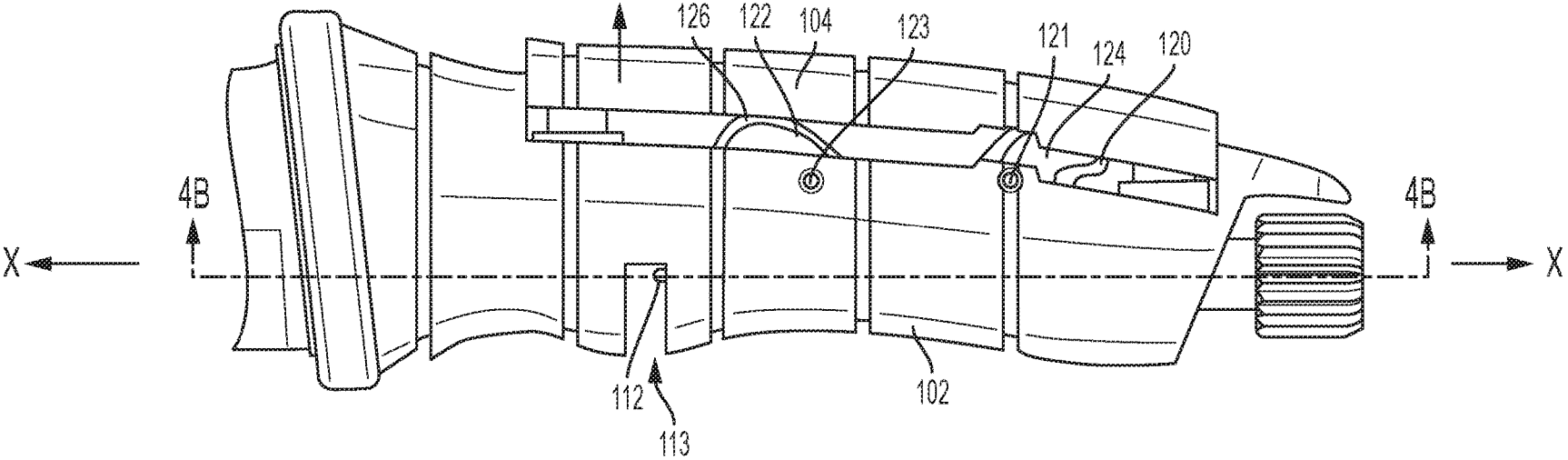
Figure 4A:
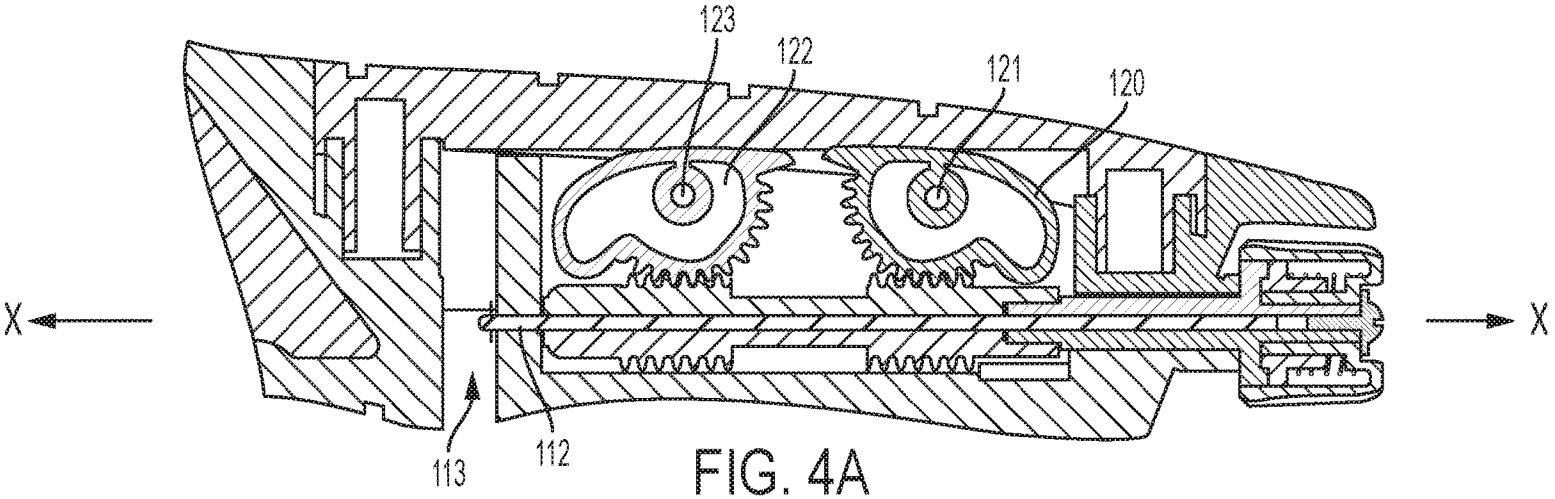
FIGS. 4A and 4B are cross-sectional views taken along section lines 4A-4A of FIGS. 3A and 4B-4B of FIG. 3B, respectively, in accordance with an embodiment.
Figure 4B:
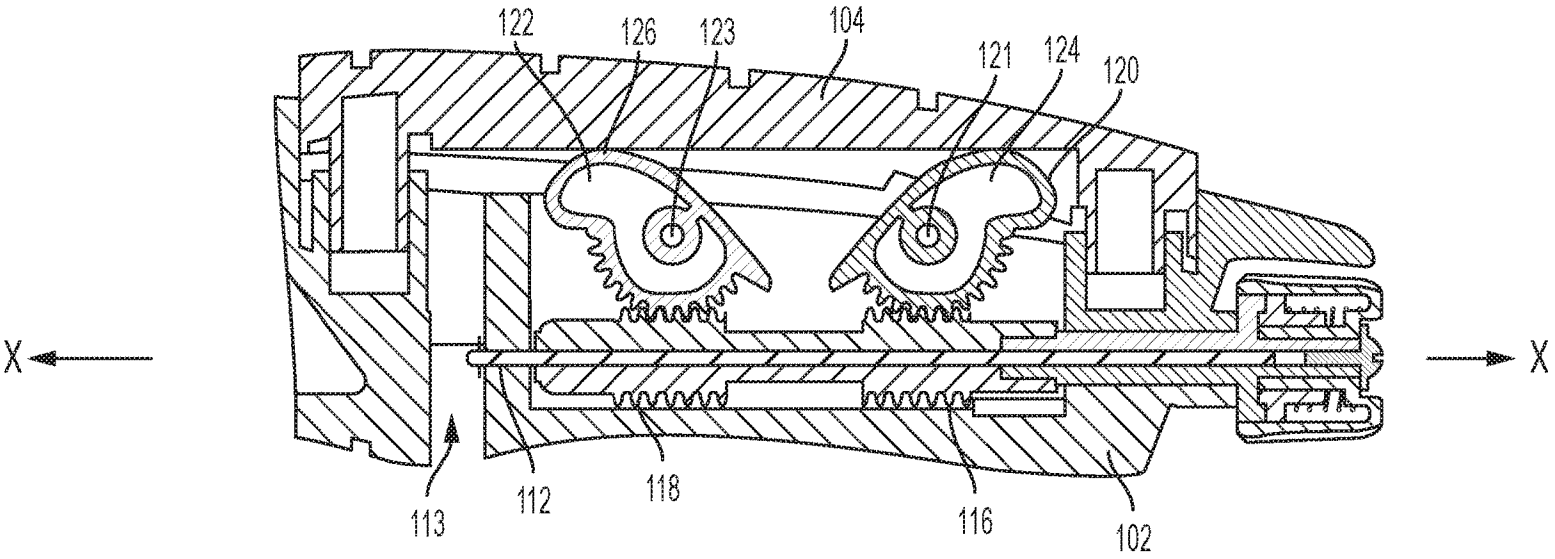
Figure 5B:
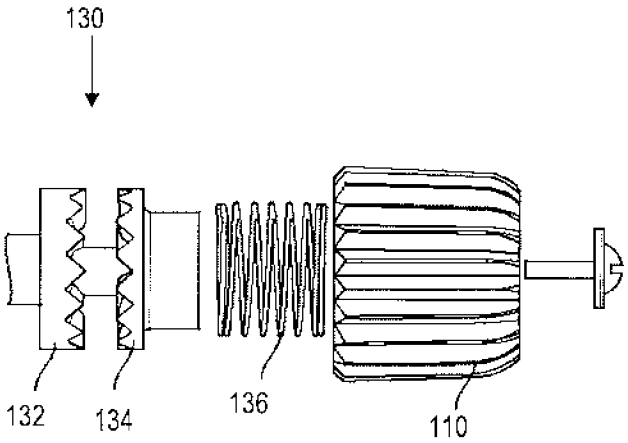
FIG. 5A nd 5B are side elevation views of a clutch assembly, in accordance with an embodiment.
Figure 5A:
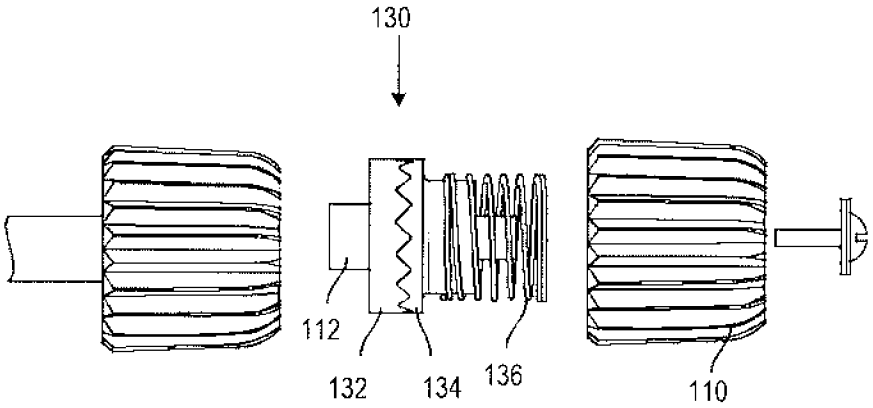

Referring to FIG. 1, in one embodiment, is a knife, designated generally by reference numeral 10, having a conventional blade 12 and a handle assembly designated generally by reference numeral 100 to which blade 12 is connected. Knife 10 extends along a longitudinal axis X-X.

A principal component of handle assembly 100 is handle 102 that includes an elongated, selectively adjustable, pliable portion 104 (e.g., composed of plastic, rubber, leather, etc.) that extends along the upper portion of handle 102, as well as a covering 103 that can be selectively changed by the user (i.e., if the user desires a tacky grip versus a harder grip or a grip with different ergonomics constructed into the covering). A cavity 106 is formed within handle 102 below pliable portion 104. Pliable portion 104 is held to the rest of handle 102 by fastening elements 108 that are positioned at each end of the pliable portion 104 such that its ends are relatively fixed in position relative to the rest of handle 102 while its intermediate portion is capable of moving away and towards cavity 106.

In addition to handle 102 and its pliable portion 104, handle assembly 100 further comprises a user accessible knob 110 positioned exteriorly of handle 102 and attached to one end of an elongated rod 112 via fastener 114. In an embodiment, rod 112 extends along axis X-X (e.g., co-axial with knife 10, although it could extend along a parallel or even non-parallel axis) that goes through handle 102 and cavity 106 and terminates in a notched cut-out area 113 formed in handle 102 where it is fastened to prevent inadvertent dislodgement. Integrated with (connected to or integral with) rod 112 is a pair of worm gears 116, 118 both of which are positioned within cavity 106. Worm gears 116, 118 operably mesh/engage with a pair of geared cams 120, 122, respectively, which are spaced from one another along axis X-X. Geared cams 120, 122 each are mounted to handle assembly 100 within cavity 106 for rotational movement about the longitudinal axes of mounting shafts 121, 123, respectively, and comprise cam surfaces 124, 126, respectively, that abut the inwardly facing surface of pliable portion 104. As a user rotates knob 110 and hence rod 112, worm gears 116, 118 cause geared cams 120, 122 to rotate about their respective axes and force cam surfaces 124, 126 to push upwardly on pliable portion 104 causing it to extend outwardly and increase the width/diameter of handle 102, or move in a direction away from pliable portion 104 in which case pliable portion maintains contact with the cam surfaces and elastically return to a more collapsed position. The pliable nature of pliable portion 104 provides it with the elasticity to move pursuant to the force imposed by cams 120, 122.

To prevent inadvertent rotation of rod 112, a clutch assembly 130 is provided and comprises a 2-piece clutch gear 132, 134 with gear 132 being rigidly connected to rod 112 and gear 134 slidingly positioned along axis X-X for movement into and out of meshing engagement with gear 132. A coil spring 136 is positioned between gear 134 and knob 110 and in its uncompressed state maintains the two gears 132, 134 out of meshed engagement with one another. To put the gears 132, 134 into engagement, the user would push inwardly on knob 110, compressing spring 136 and biasing gear 134 into engagement with gear 132. Knob 110 may then be rotated about axis X-X to cause rod 112 to rotate and ultimately force cam surfaces to raise or lower pliable portion 104.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

The above-described embodiments of the described subject matter can be implemented in any of numerous ways. For example, some embodiments may be implemented using hardware, software or a combination thereof. When any aspect of an embodiment is implemented at least in part in software, the software code can be executed on any suitable processor or collection of processors, whether provided in a single device or computer or distributed among multiple devices/computers.

What is claimed is:

1. A tool handle assembly adapted for attachment to a tool, comprising:

a. an elongated handle having a cavity formed therein and a pliable section positioned adjacent said cavity;

b. an elongated rod extending along a longitudinal axis and into said cavity;

c. a user engageable member attached to said rod on the exterior of said handle and adapted to permit selective rotation of said rod about its longitudinal axis;

d. a first cam positioned within said cavity and in abutting relation to said pliable section and engaged with said rod, wherein rotation of said rod about its longitudinal axis translates to movement of said first cam into said pliable section an amount corresponding to the degree of rotation;

e. a second cam positioned within said cavity in spaced relation to said first cam and in abutting relation to said pliable section and engaged with said rod, wherein rotation of said rod about its longitudinal axis translates to movement of said second cam into said pliable section with varying degrees of pressure; and f. a first and second worm gears integrated with said rod; and g. first and second gears integrated with said first and second cams, respectively, wherein each of said first and second worm gears mesh with said first and second gears, respectively, whereby rotation of said rod causes said first and second gears to be driven by said first and second worm gears, respectively.

2. The tool handle assembly according to claim 1, further comprising a clutch gear operable between engaged and disengaged positions and operatively interconnected with said user engageable member.

3. A tool, comprising:

a. an implement;

b. a handle assembly to which said implement is connected, said handle assembly comprising:

i. an elongated handle having a cavity formed therein and a pliable section positioned adjacent said cavity;

ii. an elongated rod extending along a longitudinal axis and into said cavity;

iii. a user engageable member attached to said rod on the exterior of said handle and adapted to permit selective rotation of said rod about its longitudinal axis;

iv. a first cam positioned within said cavity and in abutting relation to said pliable section and engaged with said rod, wherein rotation of said rod about its longitudinal axis translates to movement of said first cam into said pliable section an amount corresponding to the degree of rotation; and v. a second cam positioned within said cavity in spaced relation to said first cam and in abutting relation to said pliable section and engaged with said rod, wherein rotation of said rod about its longitudinal axis translates to movement of said second cam into said pliable section with varying degrees of pressure; and vi. a first and second worm gears integrated with said rod; and vii. first and second gears integrated with said first and second cams, respectively, wherein each of said first and second worm gears mesh with said first and second gears, respectively, whereby rotation of said rod causes said first and second gears to be driven by said first and second worm gears, respectively.

4. The tool according to claim 3, wherein said handle assembly further comprises a clutch gear operable between engaged and disengaged positions and operatively interconnected with said user engageable member.

5. A method for selectively modifying the dimension of a hand tool, comprising:

a) providing the tool of claim 1; and b) rotating the user engageable member about its longitudinal axis, whereby the pliable portion of the handle moves an amount corresponding to the rotational movement.

* * * * *